US006237265B1

(12) United States Patent
Crowell

(10) Patent No.: US 6,237,265 B1
(45) Date of Patent: May 29, 2001

(54) PROMOTIONAL DISPLAY SYSTEM

(75) Inventor: Christopher S. Crowell, Essex, CT (US)

(73) Assignee: Structural Graphics LLC, Essex, CT (US)

( * ) Notice: Subject to any disclaimer, the term of this patent is extended or adjusted under 35 U.S.C. 154(b) by 0 days.

(21) Appl. No.: 09/318,675

(22) Filed: May 25, 1999

(51) Int. Cl.[7] ..... G09F 11/00

(52) U.S. Cl. ..... 40/491; 40/488; 40/490; 40/445

(58) Field of Search ..... 40/491, 488, 508, 40/445, 490

(56) References Cited

U.S. PATENT DOCUMENTS

| | | | | |
|---|---|---|---|---|
| 733,819 | | 7/1903 | Demmon . | |
| 946,407 | * | 6/1910 | Spiegel | 40/445 |
| 1,658,968 | * | 2/1928 | Carroll | 40/488 |
| 2,085,803 | | 7/1937 | Harrison . | |
| 2,367,967 | | 1/1945 | Schwartz . | |
| 2,884,724 | | 5/1959 | Lohnes et al. . | |
| 3,848,348 | | 11/1974 | Hawley . | |
| 4,005,535 | * | 2/1977 | Davis | 40/488 X |
| 5,088,220 | | 2/1992 | Hibsch . | |
| 5,285,589 | * | 2/1994 | Hyatt | 40/491 X |
| 5,913,615 | * | 6/1999 | Rellinger | 40/491 |
| 6,061,938 | * | 5/2000 | Young | 40/490 |

* cited by examiner

*Primary Examiner*—Terry Lee Melius
*Assistant Examiner*—James M Hewitt
(74) *Attorney, Agent, or Firm*—Melvin I. Stoltz

(57) ABSTRACT

By providing a unique, pre-printed housing within which a pair of display members are operatively interconnected to each other to move simultaneously outwardly from the housing in an unexpected and unanticipated manner, a printed, visually exciting and interest generating advertising/promotional product is attained. In the preferred embodiment, the housing incorporates a front panel and a rear panel interconnected to each other and mounted in juxtaposed, spaced relationship defining an interior zone there-between. Each panel preferably comprises an eye-catching, visual display for generating consumer interest. In addition, an interior partition is mounted between the front panel and the rear panel, with the interior partition being affixed to one of said panels. Furthermore, an endless band is mounted about the interior partition in a manner which enables the endless band to freely slide peripherally about the partition in a continuous manner. By affixing two separate and independent display members directly to opposite sides of the endless band, in a manner which produces simultaneous movement of both display members in opposite directions, the desired promotional product is attained.

15 Claims, 3 Drawing Sheets

Fig.1
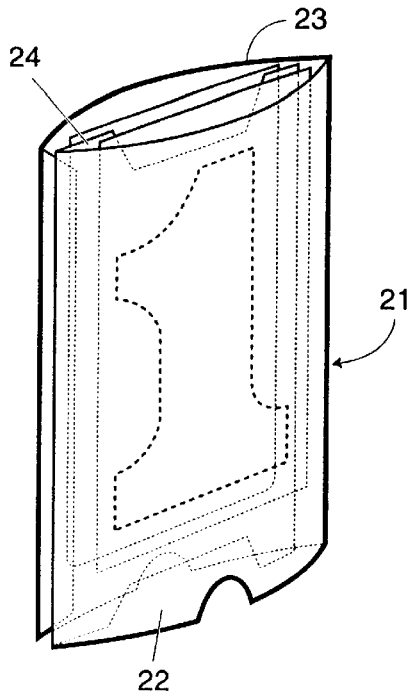
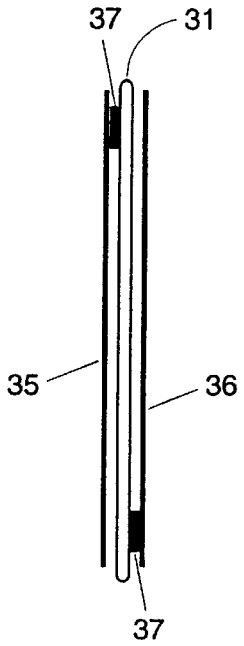
Fig.3
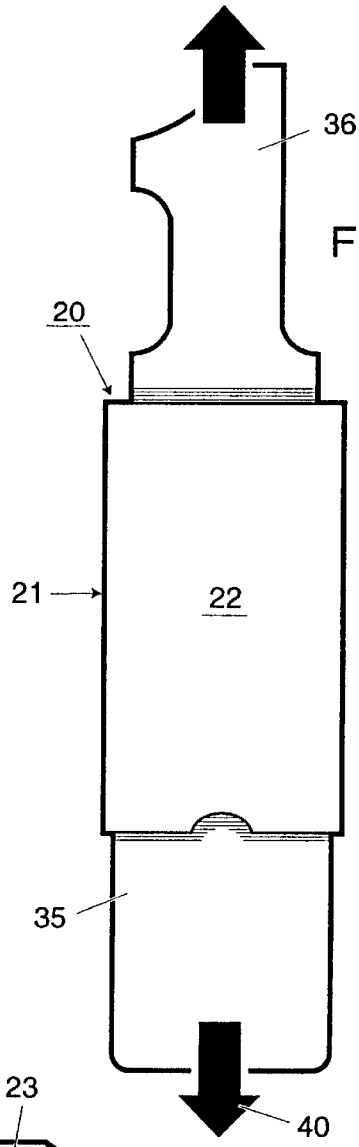
Fig.4
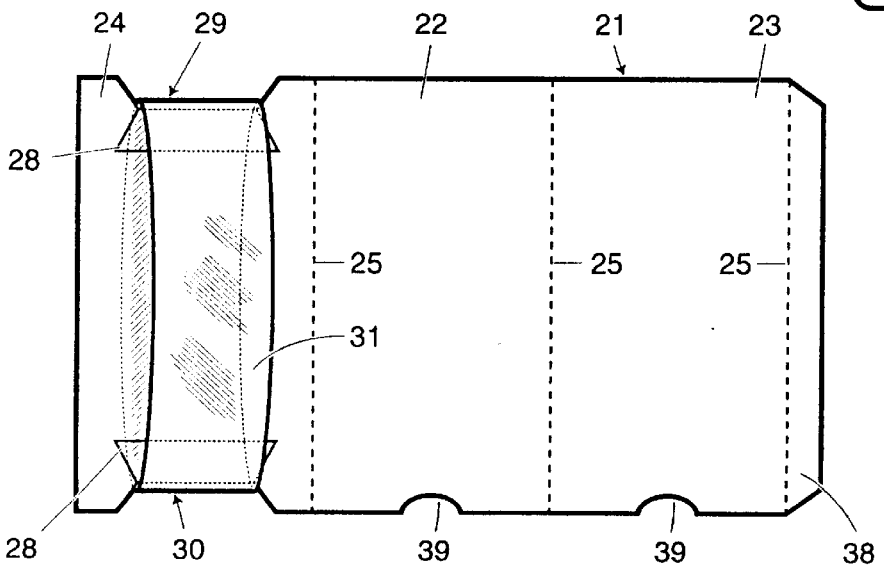
Fig.2

PROMOTIONAL DISPLAY SYSTEM

BACKGROUND ART

With the ever increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed upon developing eye-catching visual displays and promotional material which will receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when activated or unfolded. However, in spite of the unique visual appearance generated by such products, the overall cost of production and complexity of assembly of these systems has prevented such prior art systems from becoming popular.

Other prior art displays have attempted to generate consumer interest by providing unique visual images or other indicia as an integral part of the display. However, these prior art attempts have also failed to generate the consumer interest being sought, largely due to an inability to physically involve the consumer in the promotion or display.

Therefore, it is a principal object of the present invention to provide a printed advertising or promotional product which is capable of being produced at a reasonable cost and provides an exciting, interest generating display.

Another object of the present invention is to provide a printed advertising or promotional product, having the characteristic features described above, which enables the consumer to physically control the presentation of the display in a unique hands-on manner.

Another object of the present invention is to provide a printed advertising or promotional product, having the characteristic features described above, which is capable of mass production and assembly.

A further object of the present invention is to provide a printed advertising or promotional product, having the characteristic features described above, which provides a unique, eye-catching, exciting and surprising pop-up display which is produced in response to action by the consumer.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest generating advertising/promotional product is attained. This desirable and previously unattainable result is realized in the present invention by providing a unique, pre-printed housing within which a pair of display members are operatively interconnected to each other to move simultaneously outwardly from the housing in an unexpected and unanticipated manner.

In accordance with the present invention, a housing is provided which incorporates a front panel and a rear panel interconnected to each other and mounted in juxtaposed, spaced relationship defining an interior zone therebetween. Each panel preferably comprises an eye-catching, visual display for generating consumer interest. In the preferred embodiment, an interior partition is mounted between the front panel and the rear panel, with the interior partition being affixed to one of said panels. Furthermore, an endless band is mounted about the interior partition in a manner which enables the endless band to freely slide peripherally about the partition in a continuous manner. The promotional product of the present invention is completed by affixing two separate and independent display members directly to opposite sides of the endless band in a manner which produces simultaneous movement of both display members in opposite directions.

By employing this construction, a visually exciting and interest generating advertising/promotional product is obtained which enables a consumer to physically engage a portion of one of the display members when the display member is mounted within the housing. Then, by longitudinally moving a first display member in a first direction relative to the housing, movement of the second display member is produced to the surprise of the consumer.

Since the first display member is affixed to one side of the endless band, the longitudinal movement of the first display member causes the endless band to slidably rotate about the interior partition to which the band is mounted. Furthermore, since the second display member is affixed to the opposed side of the endless band, the movement of the band causes the second display member to move simultaneously therewith in a longitudinal direction opposite from the direction in which the first display member is moved.

As a result of this construction, the consumer-generated longitudinal movement of the first display member automatically causes the second display member to pop-up out of the housing in a direction opposite from the direction in which the first display member is being moved. This sudden and unexpected result surprises the consumer, causing excitement and interest in the advertising/ promotional product and the information contained thereon. In this way, consumer interest is generated both in the advertising/ display product, as well as the message being promoted by the product.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 1 is a perspective view of one embodiment of a fully assembled advertising/promotional product manufactured in accordance with the present invention with the movable display members mounted in the housing;

FIG. 2 is a plan view of a disassembled housing shown with the endless band mounted in place;

FIG. 3 is a side elevation view depicting the two display members mounted to the endless band;

FIG. 4 is a front elevation view depicting a fully assembled advertising/ promotional product of the present invention shown it is fully displayed position;

Figure 9:
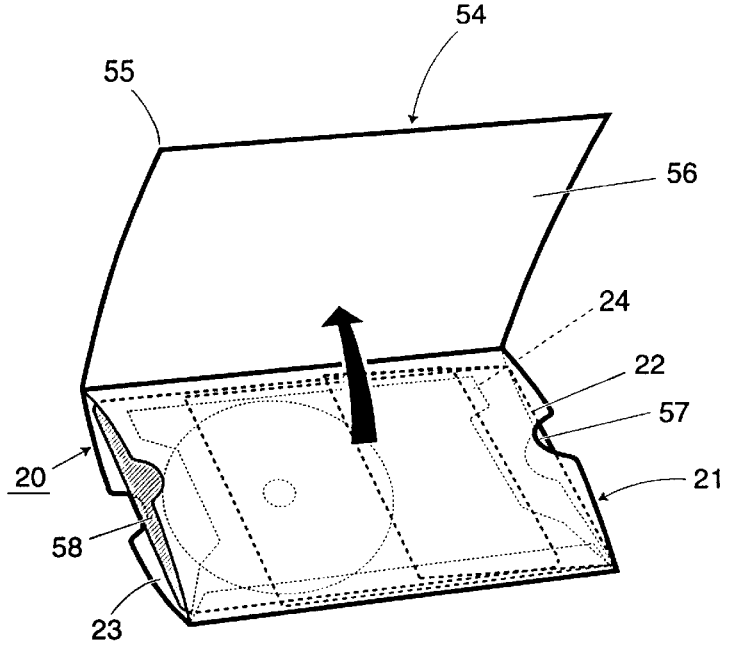
Figure 10:
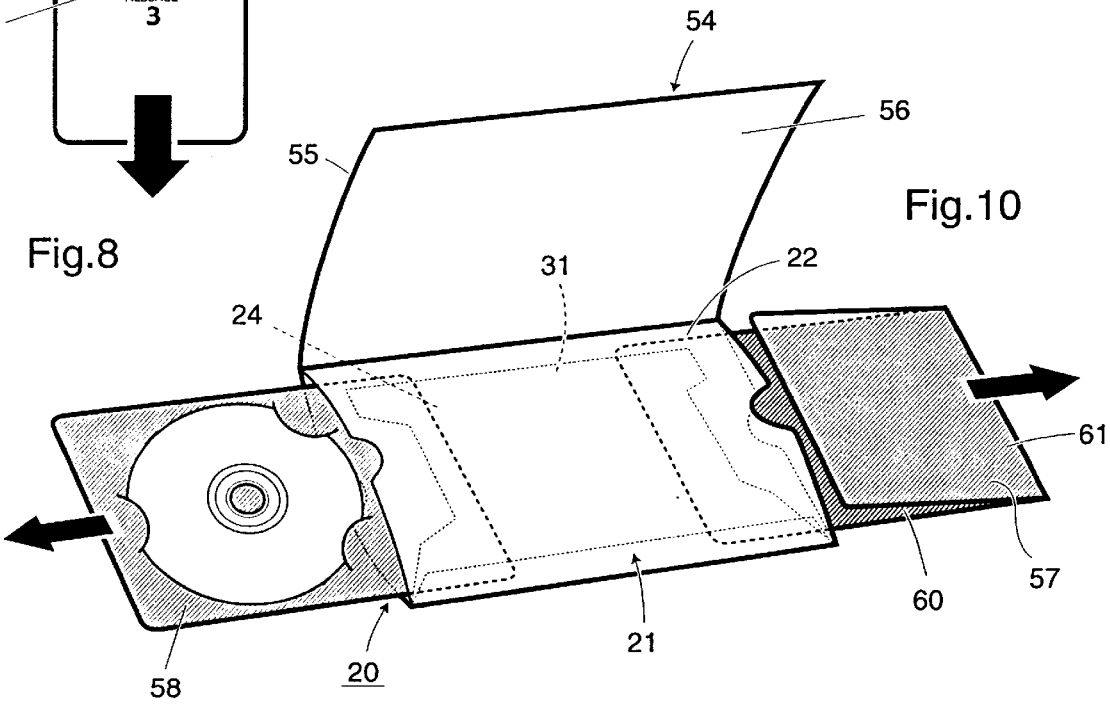

FIG. 9 is a perspective view of a still further embodiment of a fully assembled advertising/promotional product of the present invention having a pivotable panel and constructed for secretly retaining information or products therein, with the information/products shown in the stored position; and FIG. 10 is a perspective view of the embodiment of FIG. 9 shown with the information/products fully displayed.

DETAILED DISCLOSURE

By referring to FIGS. 1–7, along with the following detailed discussion, the construction and operation of two alternate embodiments for the advertising/promotional product of the present invention can best be understood. However, the present invention may be implemented in a wide variety of alternate constructions. Consequently, the embodiments detailed herein are provided for exemplary purposes only and are not intended as a limitation of the scope of the present invention.

In FIGS. 1–4, a first embodiment of the visual exciting and interest generating advertising/promotional product 20 of the present invention is depicted. In this embodiment, advertising/promotional product 20 comprises a housing 21 which incorporates a front panel 22, a rear panel 23, and interior partition 24. In order to assure that housing 21 is visually stimulating and capable of generating consumer interest, the outer surfaces of front panel 22 and rear panel 23 preferably incorporate eye-catching indicia printed thereon which provides the consumer with information regarding the particular product or service being promoted or advertised.

As shown in FIG. 2, in the preferred embodiment, front panel 22, rear panel 23, and interior partition 24 are preferably formed from a single continuous sheet of material which is folded, when required, along designated fold lines 25 to achieve housing 21. In this way, as fully detailed below, housing 21 is easily mass-produced and printed with the desired indicia, and then quickly and easily assembled into housing 21. In addition, a truncated conical-shaped segment 28 is formed in the top edge and bottom edge of interior partition 24, and folded inwardly, towards each other, forming truncated conical-shaped holding zones 29 and 30.

The construction of housing 21 is completed by mounting endless band 31 in holding zones 29 and 30 of interior partition 24. When properly mounted, endless band 31 is securely retained within holding zones 29 and 30 while being capable of independent, rotational, sliding movement relative to interior partition 24.

In order to complete the construction of advertising/promotional product 20 of the present invention and provide the desired surprise, excitement generating pop-up display, an indicia bearing display member 35 is mounted to one side of endless band 31, while a second, indicia bearing display member 36 is mounted to the opposed side of endless band 31. As clearly shown in FIG. 3, display member 35 is secured by fastening means 37 to endless band 31 at an upper end thereof, while display member 36 is secured by fastening means 37 to the lower end of endless band 31 on the opposite side from the mounting of display member 35. As is more fully detailed below, since endless band 31 is able to slidingly rotate relative to interior partition 24, this construction causes display member 36 to move in an upward direction in response to the downward movement of display member 35.

Once display members 35 and 36 are affixed to endless band 31, in the manner detailed above, assembly of housing 21 is quickly completed. In this regard, interior partition 24 is folded along fold line 25 to be placed in juxtaposed, spaced, overlying relationship with the rear surface of front panel 22. Then, rear panel 23 is folded along its fold line 25 causing the rear surface thereof to be placed in juxtaposed, spaced, cooperating relationship with interior partition 24, effectively sandwiching interior partition 24 and endless band 31 therebetween. This final desired position is secured by forming elongated narrow fastening strip 38 by folding strip 38 along fold line 25 adjacent rear panel 23 and applying an adhesive to strip 38 which securely affixes strip 38 to the adjacent edge of interior partition 24. In this way, housing 21 is quickly and easily completely assembled ready for distribution and use.

In the preferred embodiment, cut-out zones 39 are formed along the bottom edge of both front panel 22 and rear panel 23. By incorporating cut-out zones 39, a consumer is able to easily grasp the bottom edge of display member 35 and pull display member 35 downwardly to achieve the desired pop-up effect.

As discussed above, the outer surfaces of front panel 22 and panel 23 incorporate printed information in order to communicate to the consumer the desired promotional message. In addition, the surfaces of display members 35 and 36 also incorporate printed indicia, designs, logos, cut outs, or any other type of visually stimulating display. In this way, the desired promotional message is displayed in an easily manufactured product which is capable of delivering a unique, surprising and unexpected pop-up effect, which is completely controlled by the action provided by the consumer.

In normal use and distribution, advertising/promotional product 20 is distributed to consumers in the configuration depicted in FIG. 1. Upon reviewing the printed information or indicia displayed on panels 22 and 23, the consumer grasps the lower edge portion of display member 35 which is visible through cut-out zones 39 and, based upon intuition or printed instructions, pulls display member 35 downwardly as shown by arrow 40.

As detailed above, since display member 35 is affixed to the upper end of endless band 31, any downward movement of display member 35 causes endless band 31 to move downwardly therewith, slidingly rotating band 31 about interior partition 24. In addition, since display member 36 is affixed to the lower edge of endless band 31 on the side opposite from display member 35, the downward movement of endless band 31 with display member 35 causes the opposed side of endless band 31 to move upwardly with display member 36.

As a result, display member 36 automatically pops up, out of the top edge of housing 21, moving in the direction of arrow 41, with the same speed employed by the consumer in moving display member 35 downwardly away from the lower edge of housing 21.

In this way, an unexpected and surprising visual display is provided as display member 36 emerges from housing 21, bearing the desired visual message. This unique, visually exciting and unexpected result produces interest and excitement to the consumer, who will then continuously repeat the process by returning display members 35 and 36 into housing 21 and then causing the display members to emerge therefrom. Each time this process is repeated, the consumer is provided with enjoyment as well as the promotional information concerning the desired product or service.

Figure 7:
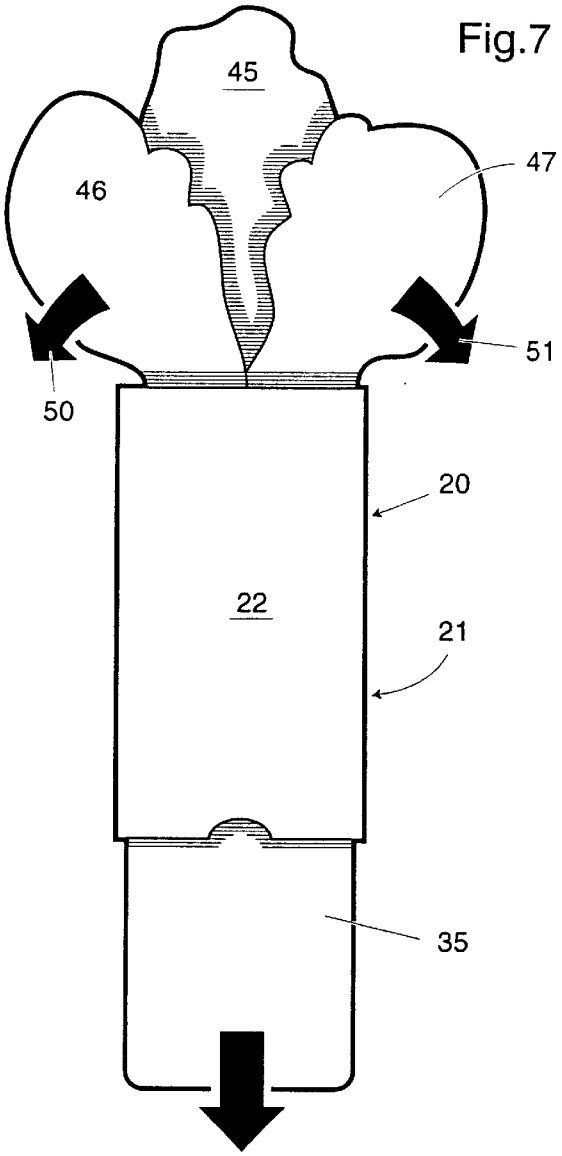
FIG. 7 is a front elevation view depicting the embodiment of FIG. 6 with the display members thereof fully removed from the housing.
Figure 6:
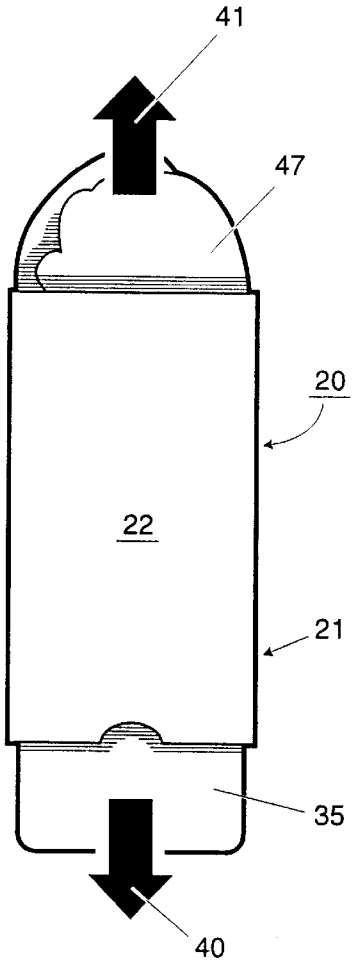
FIG. 6 is a front elevation view of the embodiment of FIG. 5 fully assembled and shown with the display members thereof partially removed from the housing.
Figure 5:
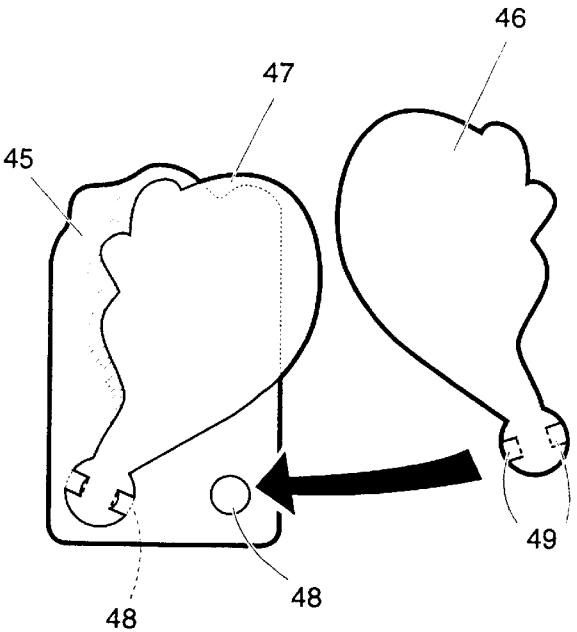
FIG. 5 is a front elevation view depicting an alternate embodiment of the advertising/promotional product of the present invention in the process of being assembled.

By referring to FIGS. 5, 6, and 7, along with the following detailed discussion, the construction and operation of an alternate embodiment of advertising/promotional product 20 of the present invention can best be understood. In this embodiment, advertising/promotional product 20 is constructed in a manner substantially identical to the construction detailed above. However, in this embodiment, display member 36 comprises a unique, visually distinctive and interest generating movable display.

In order to attain the desired, unique, movable visual display provided by this embodiment of the present invention, display member 36 comprises support panel 45 and two movable elements 46 and 47. In addition, in order to achieve the desired movement of elements 46 and 47, support panel 45 incorporates apertures 48 formed along the lower edge thereof, while movable elements 46 and 47 each incorporate locking fins 49 constructed for being engaged within apertures 48 to enable movable elements 46 and 47 to rotate therein.

As a result of this construction, display member 36 comprises support panel 45 and movable elements 46 and 47, all of which are secretly retained within housing 21 when advertising/promotional product 20 is in its first, normal position. However, when advertising/promotional product 20 is activated by the consumer grasping display member 35 and moving display member 35 downwardly, in the direction of arrow 40, as shown in FIG. 6, display member 36 begins to emerge from the top of housing 21, moving in the direction of arrow 41. However, due to the size constraints of housing 21, support panel 45 and movable elements 46 and 47 are all in overlying relationship with each other.

As the consumer continues to move display member 35 downwardly until display member 35 is fully extended outwardly from housing 21, as depicted in FIG. 7, the weight of movable elements 46 and 47 causes elements 46 and 47 to pivot in opposite, arcuate directions as each element emerges from housing 21. As shown in FIG. 7, movable element 46 moves in the direction of arrow 50, while movable element 47 moves in the direction of arrow 51. This movement effectively produces a visual display which is automatically achieved by merely moving display member 35 in a single downward direction.

By incorporating any desired indicia or visual image on support panel 45 and movable elements 46 and 47, a wide variety of interesting and exciting visual displays are attained as panel 45 and elements 46 and 47 emerge from housing 21, moving in opposite directions. As a result, substantially increased excitement and interest is generated in advertising/promotional product 20, as well as the product and/or service being promoted.

Figure 8:
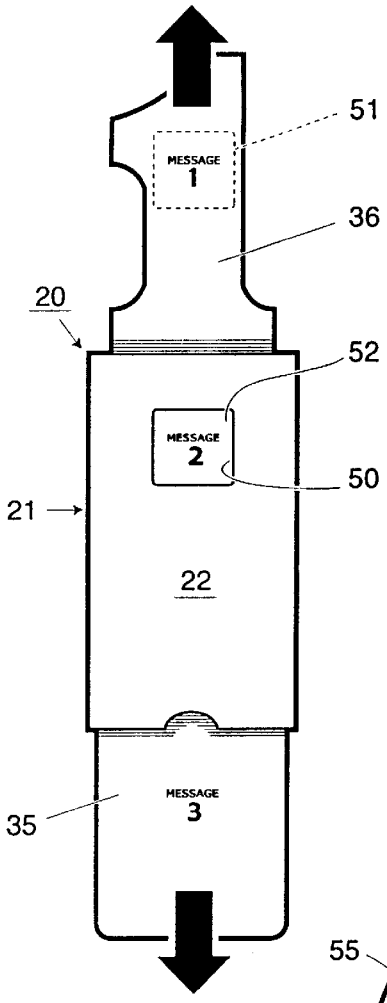
FIG. 8 is a front elevation view of an alternate embodiment of a fully assembled advertising/promotional product of the present invention shown in its fully displayed position.

In FIG. 8, a further alternate embodiment of advertising/promotional product 20 of the present invention is shown wherein an enhanced visual display is provided. In this embodiment, a construction similar to the construction shown in FIG. 4 is provided incorporating a housing 21 consisting of front panel 22 and rear panel 23. In addition, housing 21 incorporates an interior panel and an endless band movably mounted thereon as previously discussed. In addition, display members 35 and 36 are also provided with both display members being affixed to the endless band described above.

In this embodiment, the principal distinguishing feature is the incorporation of a cut-out zone 50 formed on front panel 22 of housing 21. Although not shown, a similar cut-out zone may also be formed on rear panel 23.

In order to provide enhanced excitement and visual stimulation in this embodiment of advertising/promotional product 20, display member 36 incorporates a display zone 51, formed as an integral part thereof, with display zone 51 being dimensioned for being displayed through cut-out zone 50. In this way, a specific portion of the indicia formed on display member 36 is visible when display member 36 is in its first, fully retained position within housing 21. As discussed above, the indicia employed on display member 36, including the indicia contained within zone 51, may comprise one or more selected from the group consisting of words, designs, colors, symbols, cut-outs, and the like.

In this embodiment, in order to provide further enhanced visual excitement and visual stimulation, a second message bearing zone 52 is associated with the endless band for automatically appearing through cut-out zone 50 whenever display members 35 and 36 are moved into their second, fully extended and displayed position. Preferably, a message bearing panel is mounted to the endless band for being moved into alignment with cut-out zone 50 whenever display members 35 and 36 are moved into their second, extended position, while being retained within housing 21 when display panels 35 and 36 are in any other position. As a result, the appearance of the indicia contained in message bearing zone 52 provides a visually surprising presentation, since the appearance of an additional unique message in cut-out zone 50 is unanticipated.

If desired, message bearing zone 52 may be formed directly on the endless band in a position which enables message bearing zone 52 to appear through cut-out zone 50 in response to the movement of display panels 35 and 36 into their fully extended position. However, regardless of the embodiment employed for providing message bearing zone 52, this construction does provide a further enhanced visual stimulation and enhance visual excitement to the consumer.

In FIGS. 9 and 10, a still further alternate embodiment of the present is provided, wherein advertising/promotional product 20 of the present invention is constructed in a manner which enables additional information or products to be secretly retained for delivery to the consumer in an unexpected and surprising manner. Furthermore, this embodiment of the present invention also incorporates a further, additional display panel uniquely associated with housing 21 in a manner which produces an exciting visual display as well as providing a wide variety of alternate constructions and configurations that can be employed for promoting related products or services.

In this embodiment of the present invention, advertising/promotional product 20 comprises housing 21 which is formed from front panel 22 and rear panel 23 as detailed above. Furthermore, interior partition 24 is mounted within housing 21 with endless band 31 movably mounted thereto, also as detailed above. In order to provide further visual excitement and stimulation, as well as achieve an advertising/promotional product which is capable of being employed for a wide variety of products and services, advertising/promotional product 20 comprises display panel 54 which is pivotally mounted to housing 21.

In the preferred embodiment, pivotal display panel 54 comprises an upper display surface 55 and a lower display surface 56. In addition, pivotal display panel 54 is mounted along one edge thereof to an edge of housing 21 at which front panel 22 and rear panel 23 are joined.

In this way, display panel 54 is arcuately pivotable relative to housing 21, and is movable between a first position and a second position. In its first position, panel 54 overlies and substantially obscures front panel 22 while enabling the indicia on display surface 55 to be readily visible. In its second position, panel 54 is arcuately pivoted away from front panel 22 revealing the presence of front panel 22 and the indicia contained on front panel 22, as well as the indicia contained on lower display surface 56 of panel 54.

By employing this embodiment of the present invention, the available display area is substantially increased, and a substantially greater quantity of indicia and/or information is capable of being presented to the consumer. In this way, slogans, messages, logos, designs, etc. which a company would be interested in presenting to consumers are capable of being displayed in their entirety.

In the embodiment depicted FIGS. 9 and 10, pivotal display panel 54 comprises an overall dimension substantially equivalent to the dimension of front panel 22. By employing this embodiment, the available information containing display area is optimized for enabling virtually any desired product or service to be fully and completely promoted, using any desired visual display and information bearing indicia.

In addition, using this embodiment of the present invention, a wide variety of products and services can be promoted in a unique visual display where the indicia contained on adjacent panels are visually related. For example, displaying surface 56 of panel 54 may be depicted as a computer screen or monitor, while the surface of front panel 22 is depicted as a computer. As a result, a wide variety of computer related products are capable of being promoted, with the consumer been presented with a visual display which represents a complete, fully assembled miniature computer.

In a further alternate embodiment employing the present invention, pivotal display panel 54 may be formed in any desired size or shape, such as the shape of a particular product or service being promoted. As an example, panel 54 may be constructed in the shape of a cruise liner with indicia printed thereon to fully convey the appearance of the desired cruise liner being advertised. In order to integrate the appearance of display panel 54 with front panel 22, panel 22 may be constructed with indicia representing the ocean or sea. In this way, cruise ships, travel agencies, and like are able to promote their products or services in a visually distinctive and mentally stimulating manner.

In addition to providing the substantially enhanced and expanded visual displays and promotions attainable by incorporating pivotal display panel 54, as detailed above, the embodiment of advertising/promotional product 20 depicted in FIGS. 9 and 10 also comprises a unique construction for the secretly retained display members movably mounted within housing 21. In this embodiment, a uniquely constructed first movable display member and carrier 57 is employed, preferably in combination with a second movable display member and carrier 58.

As the best seen in FIG. 10, display member/carrier 57 incorporates a base 60 in combination with a pivotal flap or cover 61. Depending on the material to be secretly retained and provided to the consumer, either base 60 or flap/cover 61 may be constructed with a holding zone, such as an internal cavity or retaining tabs, in order to secretly retain any desired product or advertising information, such as a CD, floppy disk, brochure, business card, product sample, and the like.

In addition, display member/carrier 57 also incorporates surfaces upon which any desired advertising indicia is displayed. In this way, any messages, logos, graphics, slogans, symbols, designs, etc. are capable of being printed on display member/carrier 57 in substantially the same manner as this indicia would be printed on the display members detailed above in the alternate embodiments. Furthermore, display member/carrier 57 is also mounted to endless band 31 which is movably retained on interior partition 24 in order to enable display member/carrier 57 to be movable between a first stowed position within housing 21, as shown in FIG. 9, to a second, fully extended, and displayed position, as shown in FIG. 10.

In addition, movable display member/carrier 58 is also preferably constructed in a manner for retaining any desired product or advertising material, such as a CD, floppy disk, brochure, business card, product sample, and the like. In FIG. 10, movable display member/carrier 58 is depicted as incorporating holding tabs for retaining a compact disc. However, if desired, any other product may be retained on display member/carrier 58, as well as any desired printed indicia.

Furthermore, display member/carrier 58 is also mounted to endless band 31 for enabling display member/carrier 58 to be movable from a first fully stowed, secretly retained position, as shown in FIG. 9, to a second, fully extended and displayed position, as shown in FIG. 10.

As is evident from the foregoing detailed discussion, a wide variety of alternate advertising/promotional products are capable of being manufactured in accordance with the present invention for providing unique visual displays which are both exciting and visually stimulating. In addition, these advertising/promotional products may also be constructed for distributing, directly to a customer, a wide variety of products or literature which are secretly retained in the promotional product prior to being revealed to the consumer in a unique, stimulating and exciting manner.

In employing the teaching of the present invention, a wide variety of alternate constructions and configurations can be created. These alternate constructions can produce many different, interesting, exciting, and surprising visual displays. One such promotional display would be to convert the visual impression provided by housing 21 into a completely different construction by cleverly designing display panels 35 and 36 in a unique, visually stimulating manner.

For example, panels 22 and 23 of housing 21 may be constructed containing advertising information as is frequently found on the side panels of trucks, while display panel 36 emerges, when activated, in the shape of a tractor pulling the trailer on which the display is printed, with panel 35 representing a second tractor mounted in tandem to the first. Using this type of configuration, visual interest and consumer surprise are heightened, as well as consumer interest in the product being promoted.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. An advertising/promotional product comprising:

A. a housing comprising a front panel and a rear panel, with each panel having an exposed surface on which indicia may be displayed;

B. a support member mounted between the front panel and rear panel of said housing in secure engagement therewith;

C. an endless band mounted about the support member for rotational movement relative thereto;

D. a first display panel a. cooperatively associated with the housing and the endless band of the support member, b. movable between a first stowed position and a second exposed position, and c. having one end thereof securely affixed to the endless band; and E. a second display panel a. cooperatively associated with the housing and the endless band of the support member, b. movable between a first stowed position and a second exposed position, and c. having a portion thereof affixed to the endless band for causing the second display panel to move in response to movement of the first display panel.

2. The advertising/promotional product defined in claim 1 wherein said support member comprises dimensions consistent with the front panel and rear panel of the housing for establishing a first holding zone between said support member and said first panel and a second holding zone between said support member and said rear panel.

3. The advertising/promotional product defined in claim 2, wherein said first display panel is further defined as being mounted in said first holding zone and said second display panel is mounted in said second holding zone.

4. The advertising/promotional product defined in claim 3, wherein said second display panel is further defined as being affixed at one end thereof to the endless band, whereby said second display panel is completely retained in the housing when in its first stowed position, and is fully extended and displayed when in its second position.

5. The advertising/promotional product defined in claim 4, wherein said first display panel is mounted to the endless band for being removed from the first holding zone at one end of the housing while causing the second display panel to automatically move out of the second holding zone simultaneously therewith, emerging from the opposed end of the housing.

6. The advertising/promotional product defined in claim 1, wherein said housing comprises indicia formed on at least one of said panels.

7. The advertising/promotional product defined in claim 6, wherein said indicia comprises one or more selected from the group consisting of printed matter, messages, colors, slogans, logos, graphics, and cut-outs.

8. The advertising/promotional product defined in claim 1, wherein one of said display panels is further defined as being formed in the shape of a specific object.

9. The advertising/promotional product defined in claim 1, wherein one of said display panels comprises holding means for retaining an object for being removed therefrom.

10. The advertising/promotional product defined in claim 9, wherein holding means formed on said display panel comprises one selected from the group consisting of cavities, holding tabs, and retaining flaps.

11. The advertising/promotional product defined in claim 1, and further comprising:

F. an independent panel pivotally mounted to the housing for being movable between a first position wherein said panel overlies the housing, and a second position wherein both said panel and said housing are fully exposed.

12. The advertising/promotional product defined in claim 11, wherein said independent panel is further defined as being formed in the shape of a particular object.

13. The advertising/promotional product defined in claim 11, wherein said independent panel comprises indicia formed thereon.

14. The advertising/promotional product defined in claim 13, wherein said independent panel and said housing comprise indicia constructed for visually cooperating with each other for producing a desired visual display.

15. The advertising/promotional product defined in claim 1, wherein said front panel, rear panel, and interior partition are formed from a single elongated sheet of the material which is folded to attain the desired housing construction.

* * * * *